US005241847A

United States Patent [19]

Tsugeno et al.

[11] Patent Number: 5,241,847

[45] Date of Patent: Sep. 7, 1993

[54] ROLLING CONTROL METHOD AND APPARATUS

[75] Inventors: Masashi Tsugeno, Chofu; Makoto Miyashita, Tokorozawa, both of Japan

[73] Assignee: Kabushiki Kaisha Toshiba, Kawasaki, Japan

[21] Appl. No.: 777,301

[22] PCT Filed: Apr. 3, 1991

[86] PCT No.: PCT/JP91/00447

§ 371 Date: Dec. 3, 1991

§ 102(e) Date: Dec. 3, 1991

[87] PCT Pub. No.: WO91/15312

PCT Pub. Date: Oct. 17, 1991

[30] Foreign Application Priority Data

Apr. 3, 1990 [JP] Japan ..... 2-88583

[51] Int. Cl.[5] ..... B21B 37/12; G06F 15/00

[52] U.S. Cl. ..... 72/7; 72/10; 364/472

[58] Field of Search ..... 72/9-12, 72/16, 234; 364/469, 472

[56] References Cited

U.S. PATENT DOCUMENTS

| | | | |
|---|---|---|---|
| 3,694,636 | 9/1972 | Smith, Jr. | 364/472 |
| 3,820,711 | 6/1974 | Economopoulos et al. | 364/472 |
| 4,485,497 | 12/1984 | Miura | 72/11 |
| 4,633,692 | 6/1987 | Watanabe | 364/472 |
| 4,736,305 | 4/1988 | Watanabe | 72/11 |

FOREIGN PATENT DOCUMENTS

| | | | |
|---|---|---|---|
| 3545769 | 6/1987 | Fed. Rep. of Germany | 72/234 |
| 54-139862 | 10/1979 | Japan . | |
| 55-64910 | 5/1980 | Japan . | |
| 0126310 | 9/1980 | Japan | 72/234 |
| 57-209707 | 12/1982 | Japan . | |
| 59-73108 | 4/1984 | Japan . | |
| 0099410 | 6/1985 | Japan | 72/234 |
| 0042408 | 2/1986 | Japan . | |
| 0042409 | 2/1986 | Japan . | |
| 63-27087 | 6/1988 | Japan . | |

OTHER PUBLICATIONS

Y. Kotera and F. Watanabe, "Shape Control Method for Continuous Strip Mills", Iron and Steel Engineer, May 1987, pp. 13-17.

*Primary Examiner*—Lowell A. Larson
*Assistant Examiner*—Thomas C. Schoeffler
*Attorney, Agent, or Firm*—Foley & Lardner

[57] ABSTRACT

In order to reflect a difference between an actual value and a target value of a strip profile of a product at a tandem mill, the load pattern for the next rolled material is changed in accordance with the difference of a target value and an actual value of the crown ratio of the previously rolled material. In this case, there are calculated the coefficients of the crown ratio/load, and load/load ratio. The crown ratio difference is sequentially given to the previous stand in accordance with the load ratio to determine the change amount of the load ratio at each stand. The load pattern for the next rolled material is given while considering the change amount, to calculate the delivery thickness at each stand carrying out the rolling operation.

3 Claims, 3 Drawing Sheets

STRIP THICKNESS (mm)
SCHEDULE A
h0 h1 h2 h3 h4 h5
LOAD (TON)
LOAD PATTERN BY SCHEDULE A
P1 P2 P3 P4 P5
STRIP PROFILE
ΔCrN
Cr ACT
Cr AIM
STRIP END
STRIP CENTER
STRIP END

STRIP THICKNESS (mm)
SCHEDULE A
SCHEDULE B
h0 h1 h2 h3 h4 h5
LOAD (TON)
LOAD PATTERN BY SCHEDULE B
P1 P2 P3 P4 P5
ΔCrN

STRIP THICKNESS (mm)
SCHEDULE B
SCHEDULE C
h0 h1 h2 h3 h4 h5
LOAD (TON)
LOAD PATTERN BY SCHEDULE C
P1 P2 P3 P4 P5
ΔCrN

CALCULATION RESULTS BY LOAD PATTERN METHOD ( FINISHED STRIP THICKNESS OF 1.5mm)

INITIAL STRIP THICKNESS $h_1$ : 22mm → 11mm → 5.5mm → 2.75mm → 1.9mm → 1.5mm $\gamma_1$ ( TARGET VALUE ) : 0.800 1.000 0.900 0.700 0.500

$\gamma_1$ ( CONVERGED VALUE ) : 0.800 1.000 0.899 0.697 0.496

ROLLING CONTROL METHOD AND APPARATUS

FIELD OF THE INVENTION

The present invention relates to a rolling control method and apparatus for a tandem mill for hot-rolling a roll material such as steel and non-ferrous metal material, and which is capable of obtaining a good strip profile.

PRIOR ART

A tandem mill for hot-rolling a strip is called a hot strip mill (HSM). In HSM, prior to hot-rolling a strip, initial settings are made at each stand, such as setting a gap, roll speed, and the like. At these initial settings, it is also necessary to set the initial delivery thickness of a strip at each stand. Setting the initial delivery thickness of a strip at each stand includes a work of distributing delivery thickness at respective stands (path schedule). This path schedule influences not only the production efficiency of rolled products at the hot-rolling process, but also the production quality such as the strip profile (represented by a difference between the thickness at the central portion in the widthwise direction and the thickness at an edge portion, and crown ratio) of a strip, surface characteristics, strip thickness precision, and the like. Determining the path schedule is therefore a very important task.

With a conventional method of determining a path schedule, the delivery thickness of a strip at each stand has been determined in accordance with a rolling power curve empirically obtained. Instead of such a conventional method, a new method has been proposed and is now being used. With this new method, an optimum path schedule is determined by directly considering parameters other than the power distribution of driving motors at respective stands, the parameters including the flatness of a strip, the strip profile, and the like. This method is now mainly used in this field. Various methods of this type have been proposed as disclosed, for example, in Japanese Patent Laid-open Publications Nos. 54-139862, 55-64910, 57-209707, and 59-73108.

The method disclosed in Japanese Patent Laid-open Publication No. 54-139862, determines a path schedule in accordance with a target flatness, target strip thickness, and target strip crown, with respect to a material flatness at each path. The method disclosed in Japanese Patent Laid-open Publication No. 55-64910 determines a path schedule through learning in accordance with a target flatness, target strip thickness, and a target strip crown at each path. The method disclosed in Japanese Patent Laid-open Publication No. 57-209707 reflects reduction distribution data for respective stands obtained from the past rolling data, to a new lot. The method disclosed in Japanese Patent Laid-open Publication No. 59-73108 determines an optimum path schedule in accordance with the target values of the strip crown and strip configuration at the last stand of HSM, by using an iterative calculation method for model equations of a mechanical crown and load.

The above-described various proposed methods are associated with a problem that they cannot change rolling force for each stand which directly influences various qualities including the strip profile and configuration of a rolled product. The reason why this problem occurs will be described below.

The load pattern is represented by a ratio $\gamma_i$ of a load $P_i$ at each stand to the maximum load $P_{MAX}$.

$$\gamma_i = P_i / P_{MAX} (i = 1 \text{ to } n) \quad (1)$$

The load ratio $\gamma_i$ is defined by $0 < \gamma_i \leqq 1$, and at least one stand takes a ratio $\gamma_i = 1$. In an actual hot-rolling operation, however, the load pattern is changed, in many cases, due to complicated factors such as the roll abrasion state at each stand, a method of burning a slab at a reheating furnace, and a path schedule at a roughing mill and the like. An operator changes the load pattern of a generally theoretically or analytically obtained standard optimum path, while considering an actual rolling condition. In a system wherein a path schedule of HSM is determined and a delivery thickness and the like of a strip are calculated and set in accordance with the path schedule, it is necessary to automatically set such values without a help of an operator and obtain a good product during an ordinary or normal rolling operation. It is also important that an operator can easily assist rolling operation during an abnormal state. To this end, it becomes necessary to give an optimum path schedule by using the load pattern $\gamma_i$ which is a direct index for an operator.

However, in a conventional HSM system wherein the delivery thickness and the like of a strip is calculated and set, although it is theoretically possible to determine an optimum path schedule by using the above-described various proposed methods, there is a fatal disadvantage that it is difficult to directly operate the system in order to change the load pattern $\gamma_i$. It can be said therefore that the above-described various proposed methods do not work necessarily in an efficient manner.

As apparent from the foregoing description, a system must allow the determination of an optimum path schedule while considering the qualities of a rolled product such as the strip profile, configuration and the like, and allow an operator to easily deal with changes of various conditions during rolling operation. Nevertheless, a conventional method of determining an optimum path schedule for HSM has a problem that an optimum path schedule cannot be easily determined and an operator cannot easily help the rolling operation. The main reason for the presence of such a problem is that an optimum path schedule is not determined by using the load pattern $\gamma_i$ at each stand. As a result, the conventional method of determining an optimum path schedule for HSM cannot be used effectively.

SUMMARY OF THE INVENTION

The present invention has been made to solve the above-described prior art problems. It is an object of the present invention to provide a rolling control method and apparatus capable of obtaining a good strip profile of a rolled product and flexibly dealing with an actual rolling operation.

In order to achieve the above object, the present invention provides a rolling control method of setting a roll gap $S_i$ and roll peripheral speed $V_i$ at each stand of a tandem mill and controlling the roll gap and roll peripheral speed in accordance with the set values so as to obtain a rolled material having a predetermined strip crown, the rolling control method comprising:

a step of detecting a strip profile of a rolled material which has undergone a series of hot strip rolling;

a step of calculating a strip crown actual value $C_r^{ACT}$ of the rolled material in accordance with the detected strip profile;

a step of comparing the calculated strip crown actual value $C_r^{ACT}$ with a given strip crown target value $C_r^{AIM}$ to obtain a difference $\Delta C_{rN}$ $(=C_r^{AIM}-C_r^{ACT})$ therebetween;

a step of obtaining a crown ratio/load influence coefficient $\partial R_{ci}/\partial P_i$ in accordance with the obtained difference $\Delta C_{rN}$ and crown ratio calculated values $(R_{ci}(P_i+\Delta P_i), R_{ci}(P_i-\Delta P_i), \Delta P_i)$;

a step of calculating a load/load ratio influence coefficient $\partial P_i/\partial \gamma_i$ in accordance with given load calculated values $(P_i(\gamma_i+\Delta\gamma_i), (P_i(\gamma_i-\Delta\gamma_i), \Delta\gamma_i)$;

a step of calculating a load ratio correction amount $\delta\gamma_i$ in accordance with the given delivery target value $h_F^{AIM}$, strip crown difference $\Delta C_{rN}$, influence coefficient $\partial R_{ci}/\partial P_i$, and influence coefficient $\partial P_i/\partial \gamma_i$, at the rolled material at the most downstream stand;

a step of calculating a delivery thickness $h_i$ at each stand realizing a load pattern $\gamma_i^{NEW}$ for the next rolled material, in accordance with the given load pattern $\gamma_i^{OLD}$ and load ratio correction amount $\delta\gamma_i$; and a step of setting the roll gap $S_i$ and roll peripheral speed $V_i$ at each stand in accordance with the calculated delivery thickness $h_i$ at each stand.

Furthermore, the present invention provides a rolling control apparatus for setting a roll gap $S_i$ and roll peripheral speed $V_i$ at each stand of a tandem mill and controlling the roll gap and roll peripheral speed in accordance with the set values so as to obtain a rolled material having a predetermined strip crown, the rolling control apparatus comprising:

strip profile detecting means for detecting a strip profile of a rolled material which has undergone a series of hot strip rolling;

first calculating means for comparing a strip crown actual value $C_r^{ACT}$ of the rolled material calculated in accordance with the detected strip profile, with a given strip crown target value $C_r^{AIM}$ to obtain a difference $\Delta C_{rN}$ $(=C_r^{AIM}-C_r^{ACT})$ therebetween;

second calculating means for obtaining a load ratio correction amount $\delta\gamma_i$ in accordance with the difference $\Delta C_{rN}$, a crown ratio/load influence coefficient $\partial R_{ci}/\partial P_i$ obtained from crown ratio calculated values $(R_{ci}(P_i+\Delta P_i), R_{ci}(P_i-\Delta P_i), \Delta P_i)$, a load/load ratio influence coefficient $\partial P_i/\partial \gamma_i$ obtained from given load calculated values $(P_i(\gamma_i+\Delta\gamma_i), (P_i(\gamma_i-\Delta\gamma_i), \Delta\gamma_i)$, and a given delivery target value $h_F^{AIM}$ at the rolled material at the most downstream stand;

third calculating means for calculating a delivery thickness $h_i$ at each stand realizing a load pattern $\gamma_i^{NEW}$ for the next rolled material, in accordance with the load ratio correction amount $\delta\gamma_i$ and load pattern $\gamma_i^{OLD}$ of the rolled material;

setting means for setting the roll gap $S_i$ and roll peripheral speed $V_i$ at each stand in accordance with the calculated delivery thickness $h_i$ at each stand; and means for controlling a reduction unit and roll drive motor at each stand in accordance with the set roll gap $S_i$ and roll peripheral speed $V_i$.

DESCRIPTION OF THE PREFERRED EMBODIMENTS

The present invention will be further described with reference to the accompanying drawings.

Figure 1:
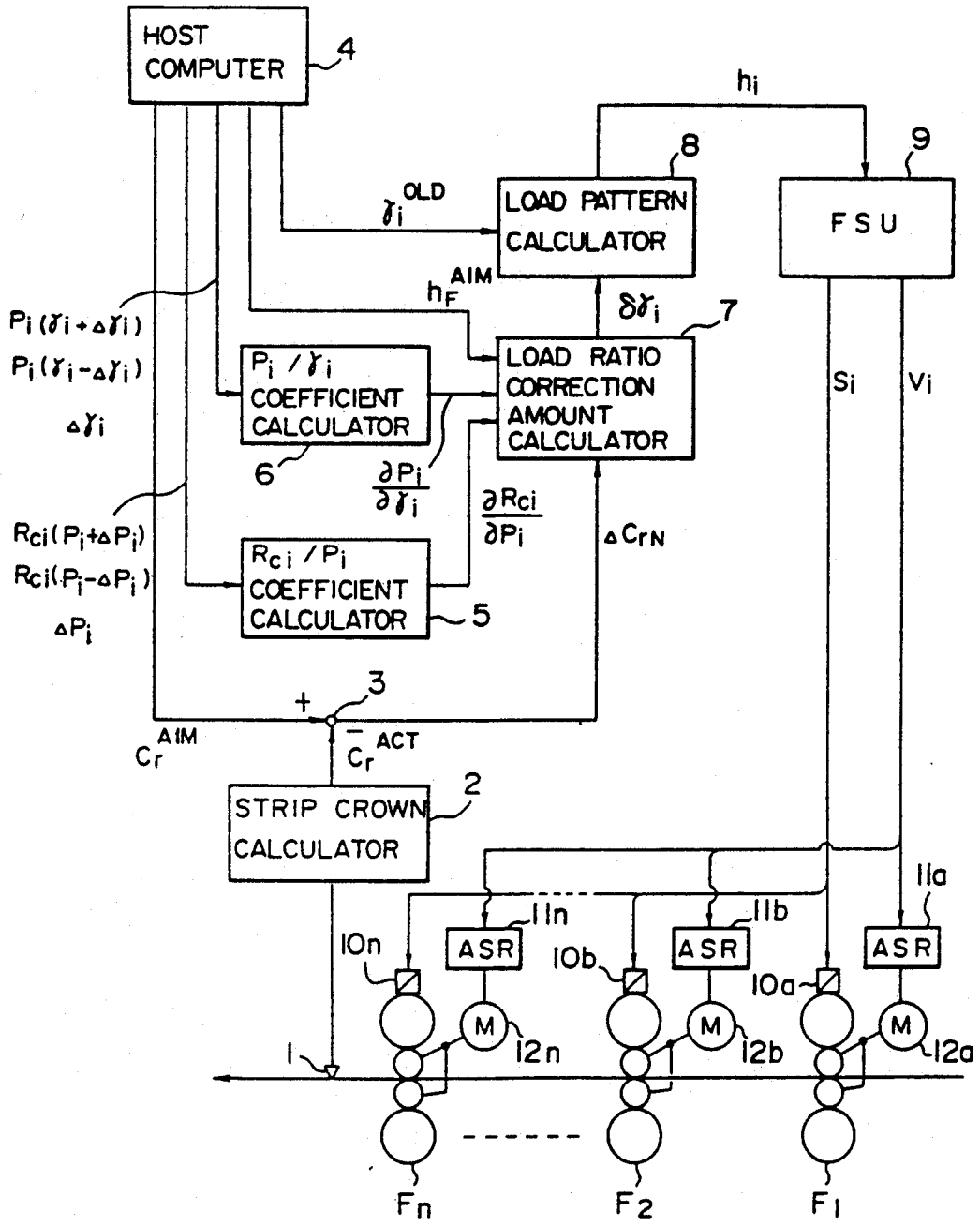
FIG. 1 is a block diagram showing the structure of a rolling control apparatus according to an embodiment of the present invention.

FIG. 1 is a block diagram showing the structure of a rolling control apparatus according to the embodiment of the present invention.

The rolling control apparatus of FIG. 1 controls rolling mills $F_1$ to $F_n$ at n stands for carrying out hot strip rolling. The rolling control apparatus is also provided with a profile unit 1, strip crown calculator 2, comparator 3, host computer 4, $R_{Li}/P_i$ coefficient calculator 5, $P_i/\gamma_i$ coefficient calculator 6, load ratio correction amount calculator 7, load pattern calculator 8, calculation/setting unit (FSU) 9, and reduction units $10_a$ to $10_n$.

The profile unit 1 is mounted at the delivery side of the rolling mill $F_n$ at the n-th stand positioned most downstream among the tandem-arranged rolling mills $F_i$ to $F_n$. In the tandem mill system constituted by the rolling mills $F_1$ to $F_n$ at n stands, the profile unit 1 detects the strip profile of a rolled material which has undergone hot strip rolling. The detected result is sent to the strip crown calculator 2. The strip profile detection signal outputted from the profile unit 1 represents the strip profile of a rolled material which has undergone hot strip rolling carried out with the values calculated and set using a load pattern $\gamma_i$, to be described later, and the delivery thickness $h_i$ at each stand. The strip profile unit 1 may use, for example, an apparatus for measuring the strip thickness of a rolled material in the widthwise direction by applying an X-ray.

The reduction units 10*a* to 10*n* are disposed in a one-to-one correspondence with the rolling mills $F_1$ to $F_n$. The reduction unit 10*a* is disposed at the rolling mill $F_1$ at the first stand positioned most upstream, the reduction unit $F_2$ is disposed at the second rolling mill $F_2$, and the reduction unit 10*n* is disposed at the n-th rolling mill $F_n$. In FIG. 1, the rolling mill $F_1$ at the first stand, rolling mill $F_2$ at the second stand, and rolling mill $F_n$ at the n-th stand only are depicted for the simplicity of the drawing. Each of the reduction units 10*a* to 10*n* adjust the reduction position of a roll in accordance with a roll gap value $S_i$ which is calculated and set by the calculation/setting unit (FSU) 9, and supplied to each stand.

The strip crown calculator 2 receives from the profile unit 1 the strip profile detection signal detected from a rolled material which has undergone a series of hot strip rolling. In accordance with the strip profile detection signal, the strip crown calculator 2 obtains the strip crown actual value $C_r^{ACT}$ of the rolled material and sends it to the comparator 3. The strip crown actual value $C_r^{ACT}$ is obtained after hot-strip-rolling a rolling material in accordance with the load pattern $\gamma_i^{OLD}$. Therefore, the strip crown actual value $C_r^{ACT}$ has been greatly influenced by the load pattern $\gamma_i^{OLD}$.

The host computer 4 supplies the strip crown target value $C_r^{AIM}$ of a rolled material to undergo hot strip rolling, to the comparator 3. The host computer 4 supplies values $R_{ci}(P_i+\Delta P_i)$, $R_{ci}(P_i-\Delta P_i)$, and $\Delta P_i$ to the $R_{ci}/P_i$ coefficient calculator 5, the values being necessary for calculating a crown ratio/load ratio influence coefficient $\partial R_{ci}/\partial P_i$. The value $R_{ci}(P_i+\Delta P_i)$ ($\Delta P_i$ is a fine difference of a load, for example, $\Delta P_i=0.02\ P_i$ is given) is a delivery side crown ratio of the rolling mill at the i-th stand having a load $P_i$. The host computer 4 also supplies values $P_i(\gamma_i+\Delta\gamma_i)$, $P_i(\gamma_i-\Delta\gamma_i)$, and $\Delta\gamma_i$ to the $P_i/\gamma_i$ coefficient calculator 6, the values being necessary for calculating a load/load ratio influence coefficient $\partial P_i/\partial\gamma_i$. The host computer 4 also supplies a delivery target thickness value $h_F^{AIM}$ of a rolled material at the rolling mill $F_n$ to the load ratio correction amount calculator 7. The host computer 4 also supplies the load pattern $\gamma_i^{OLD}$ (i=1 to n) at the rolling mills at respective stands under a rolling step of a rolled material undergoing hot strip rolling, to the load pattern calculator 8.

The comparator 3 receives the strip crown actual value $C_r^{ACT}$ outputted from the strip crown calculator 2 and the strip crown target value $C_r^{AIM}$ outputted from the host computer 4 to obtain a difference $\Delta C_{rN}$ ($C_r^{AIM}-C_r^{ACT}$) and supply it to the load ratio correction amount calculator 7.

The $R_{ci}/P_i$ coefficient calculator 5 receives the data $R_{ci}(P_i+\Delta P_i)$, $R_{ci}(P_i-\Delta P_i)$ and $\Delta P_i$ outputted from the host computer 4 to calculate the crown ratio/load influence coefficient $\partial R_{ci}/\partial P_i$ using the following equation.

$$\frac{\partial R_{ci}}{\partial P_i} = \frac{R_{ci}(P_i+\Delta P_i) - R_{ci}(P_i-\Delta P_i)}{2\cdot\Delta P_i} \quad (2)$$

The $R_{ci}/P_i$ coefficient calculator 5 supplies the value of the crown ratio/load influence coefficient $\partial R_{ci}/\partial P_i$ obtained using equation (2) to the load ratio correction amount calculator 7.

The $P_i/\gamma_i$ coefficient calculator 6 receives the data $P_i(\gamma_i+\Delta\gamma_i)$, $P_i(\gamma_i-\gamma\Delta_i)$, and $\Delta\gamma_i$ outputted from the host computer 4 to calculate the load/load ratio influence coefficient $\partial P_i/\partial\gamma_i$ using the following equation.

$$\frac{\partial P_i}{\partial\gamma_i} = \frac{P_i(\gamma_i+\Delta\gamma_i) - P_i(\gamma_i-\Delta\gamma_i)}{2\cdot\Delta P_i} \quad (3)$$

The $P_i/\gamma_i$ coefficient calculator 6 supplies the value of the load/load ratio influence coefficient $\partial P_i/\partial\gamma_i$ obtained using equation (3) to the load ratio correction amount calculator 7.

The load ratio correction amount calculator 7 receives the difference $\Delta C_{rN}$ outputted from the comparator 3, the crown ratio/load influence coefficient $\partial R_{ci}/\partial P_i$ outputted from the $R_{ci}/P_i$ coefficient calculator 5, the load/load ratio influence coefficient $\partial P_i/\partial\gamma_i$ outputted from the $P_i/\gamma_i$ coefficient calculator 6, and the delivery target thickness value $h_F^{AIM}$ of a rolled material at the rolling mill $F_n$ outputted from the host computer 4, to calculate a load ratio correction amount $\delta\gamma_i$ by using the following equations (4) and (5). The load ratio correction amount is used for determining a path schedule of a rolled material to be newly subject to hot strip rolling.

$$\frac{\partial R_{ci}}{\partial P_i}\cdot\frac{\partial P_i}{\partial\gamma_i}\cdot\partial\gamma_i = \frac{\Delta C_{rN}}{h_F^{AIM}} \quad (i=1\sim n) \quad (4)$$

-continued $$\therefore\ \delta\gamma_i = \frac{\Delta C_{rN}}{h_F^{AIM}} \Big/ \left(\frac{\partial R_{ci}}{\partial P_i}\cdot\frac{\partial P_i}{\partial\gamma_i}\right) \quad (i=1\sim n) \quad (5)$$

The equations (4) and (5) indicate that the strip crown difference $\Delta C_{rN}$ obtained from the past rolling of a rolled material is uniformly absorbed in each stand by the same amount, by changing the load distribution pattern for each stand. It is obvious that the calculation using equations (2) to (5) is carried out for each of the rolling mills at n stands. The obtained load ratio correction amount $\delta\gamma_i$ (i=1 to n) is supplied to the load pattern calculator 8.

The load pattern calculator 8 receives the load ratio correction amount $\delta\gamma_i$ at each stand outputted from the load ratio correction calculator 7, and the load pattern $\delta_i^{OLD}$ (i=1 to n) of the rolling mill at each stand outputted from the host computer 4. Receiving these data, the load pattern calculator 8 executes the calculation process described below to calculate the delivery thickness $h_i$ of the rolled material at each rolling mill (i.e., a pass schedule of a rolling mill at each stand for realizing the load pattern $\gamma_i^{NEW}$ for a rolled material to be newly subject to the hot strip rolling). First, the load pattern $\gamma_i^{NEW}$ to be realized at the hot strip rolling process for a rolling material to be newly rolled, is obtained by the following equation (6).

$$\gamma_i^{NEW} = \gamma_i^{OLD} + \delta\gamma_i (i=1\ to\ n) \quad (6)$$

The delivery thickness $h_i$ of a rolled material at a rolling mill at each stand for obtaining the load pattern $\gamma_i^{NEW}$ is calculated by using the Newton-Raphson method. The load pattern is defined by the following equation (7).

$$\gamma_i = \frac{P_i}{P_{MAX}} \quad (i=1\sim n) \quad (7)$$

The value $P_{MAX}$ of equation (7) represents the maximum value of $P_i$, i.e., the maximum load value. Therefore, assuming that all values of $P_i$ are $P_i>0$, then $$0<\gamma_i\leqq 1 \quad (8)$$

The condition satisfying the relation between the delivery thickness $h_i$ of a rolled material at the rolling mill at each stand and the roll speed $V_i$ at the rolling mill at each stand is represented by a load pattern given by equation (7). Of the delivery thickness of the rolling mills at the respective stands, the delivery thickness of a rolled material at the rolling mill of the last stand $F_n$ is given by $h_n=h_f^{AIM}$ which is a known value. Similarly, the roll peripheral speed $V_n$ of the rolling mill at the last stand $F_n$ is given by a temperature model used for achieving the delivery temperature of a rolled material at the rolling mill at the last stand $F_n$, the roll peripheral speed $V_n$ being therefore a known value. The entry thickness $h_o$ (i.e., a thickness of a rolled material before subjecting to a rolling process) of a rolled material at the rolling mill of the first stand $F_1$ is given as an actual value or an operation target value, the entry thickness being therefore a known value.

A constant mass flow rule is given by the following equation.

$$(1+f_i)*h_i*V_i=U(i=1 \text{ to } n) \quad (9)$$

The relation between load patterns can be expressed by the following equation which is obtained by dividing equation (7) for a certain stand by equation (7) for the adjacent stand.

$$\frac{\gamma_i}{\gamma_{i-1}}=\frac{P_i}{P_{i-1}} \quad (i=2\sim n) \quad (10)$$

$$\therefore \gamma_i \cdot P_{i-1}=\gamma_{i-1} \cdot P_i \quad (11)$$

$f_i$ represents a forward slip ratio of a rolling mill at the i-th stand, U represents a volume speed (mm * mpm), $h_i$ represents a delivery thickness (mm), and $V_i$ represents a roll peripheral speed (mpm).

The number of equations (9) and (11) is (2n−1) in total for n rolling mills. The number of unknown values $h_i$ (i=1 to n−1), $V_i$ (i=1 to n−1), and U is (n−1)+(n−1)+1=2n−1 in total. Therefore, equations (9) and (11) can be solved completely. Equations (9) and (11) are represented as shown in the following equations (12).

$$g_j=(1+f_i)\cdot h_i\cdot V_i-U$$

$$g_j=\gamma_i\cdot P_{i-1}-\gamma_{i-1}\cdot P_i \quad (12)$$

There is a relation that j=i for j+1 to n, and j=i+n−1 (i=2 to n) for j+=n+1 to 2n−1. (2n−1) $g_j$ are disposed to form a vector {g} which is a column vector and can be represented by the following equation (13).

$$\{g\}=[g_1\, g_2 \cdots g_{2n-1}]^T \quad (13)$$

$[\ ]^T$ of equation (13) is transposition of the column vector {g}. The above-described unknown values are also disposed in a vector {g} which is given by the following equation (14).

$$\{X\}=[h_1\, h_2 \ldots h_{n-1}\, V_1\, V_2 \ldots V_{n-1}\, U]^T \quad (14)$$

The Newton-Raphson method is applied to the equations (13) and (14) to obtain the following equation (15)

$$[J]*(\{X_K\}-\{X_{K-1}\})+\{g\}\{X_{K-1}\}=\{0\} \quad (15)$$

In equation (15), {J} is a Jacobian matrix, $\{X_K\}$ is the K-th solution, and {0} is a zero vector.

The Jacobian matrix [J] is represented by the following equation (16).

$$J=\begin{bmatrix} \frac{\partial g_1}{\partial x_1} & \frac{\partial g_1}{\partial x_2} & \cdots & \frac{\partial g_1}{\partial x_{2n-1}} \\ \frac{\partial g_2}{\partial x_1} & & \cdot & \cdot \\ & & \cdot & \cdot \\ \frac{\partial g_{2n-1}}{\partial x_1} & & \cdots & \frac{\partial g_{2n-1}}{\partial x_{2n-1}} \end{bmatrix} \quad (16)$$

In equation (16), it is apparent that each item of a partial differential is calculated to obtain a numerical value. $x_j$ is the j-th component of the vector {X}. Each component of the Jacobian matrix [J] is a known value. For example, a partial differential of $g_j$ (j=1 to N) relative to $h_i$ is obtained by the following equation (17).

$$\frac{\partial g_i}{\partial h_i}=\frac{\partial f_i}{\partial h_i}\cdot h_i\cdot V_i+(1+f_i)+V_i \quad (17)$$

The equation (17) is for j=i. $\partial f_i/\partial h_i$ is calculated by the following equation (18) by using a fine difference $\Delta h_i$.

$$\frac{\partial g_i}{\partial h_i}=\frac{f_i(h_i+\Delta h_i)-f_i(h_i-\Delta h_i)}{2\cdot\Delta h_i} \quad (18)$$

It is necessary to give an initial value for obtaining a solution by using the Newton-Raphson method. Assuming that the initial value is $\{X_0\}$, the following equation stands based upon equation (15).

$$[J]*(\{X_1\}-\{X_0\})+\{g\}*(\{X_0\})=\{0\}$$

Using this equation, convergence calculation is carried out using the following equation (19).

$$\text{iteration} \downarrow \left.\begin{array}{l} \{X_1\}=\{X_0\}-[J]^{-1}\cdot\{g\}\{X_0\} \\ \{X_K\}=\{X_{K-1}\}-[J]^{-1}\cdot\{g\}\{X_K\} \end{array}\right\} \quad (19)$$

Convergence calculation is carried out by equation (19) and if a certain evaluation equation falls within an allowable error range, it is considered as convergence. A solution is $\{X_C\}$ obtained from $\{X_C\}=\{X_K\}$. $[J]^{-1}$ is an inverse matrix of the Jacobian matrix [J].

With the above-described procedure, a combination of $h_i$, $V_i$, and U satisfying the relation of $\gamma_i=\gamma_i^{NEW}$ is obtained. Of the values obtained in the above manner, the load pattern calculator 8 sends the values of the delivery thickness $h_i$ and roll peripheral speed $V_i$ of a rolled material to be newly hot-strip rolled, to the calculation/setting unit (FSU) 9.

Receiving the values of the delivery thickness $h_i$ and roll peripheral speed $V_i$ outputted from the load pattern calculator 8, the calculation/setting unit 9 obtains the roll gap $S_i$ and roll peripheral speed $V_i$ of the rolling mill at each stand. The calculation/setting unit 9 sends the obtained roll gap $S_i$ of the rolling mill at each stand to the corresponding one of the reduction units $\mathbf{10}_A$ to $\mathbf{10}_N$ provided for the rolling mill at each stand. On the other hand, the obtained roll peripheral speed $V_i$ of the rolling mill at each stand is sent to the corresponding one of motor drivers (ASR) 11*a*, 11*b*, . . . , 11*n* of the rolling mills at respective stands. Receiving the roll gap $S_i$, each of the reduction units $\mathbf{10}_a$ to $\mathbf{10}_n$ sets the roll gap of the rolling mill at each stand to a predetermined value. Receiving the roll peripheral speed $V_i$ set by the calculation/setting unit (FSU) 9, each of the motor drivers 11*a*, 11*b*, . . . , 11*n* at respective stands sets the roll peripheral speed of the rolling mill at each stand to a predetermined value by speed-controlling driver motors (M) $M_a$, $M_b$, . . . , $M_n$.

In this manner, the roll gap and roll peripheral speed of the rolling mill at each stand are set to the predetermined values to carry out the hot strip rolling for a new rolled material. As a result, the load $P_i$ of the rolling mill at each stand becomes equal to the load pattern $\gamma_i^{NEW}$ so that a product having a good strip profile can be obtained.

Figures 2A, 2B, 2C:
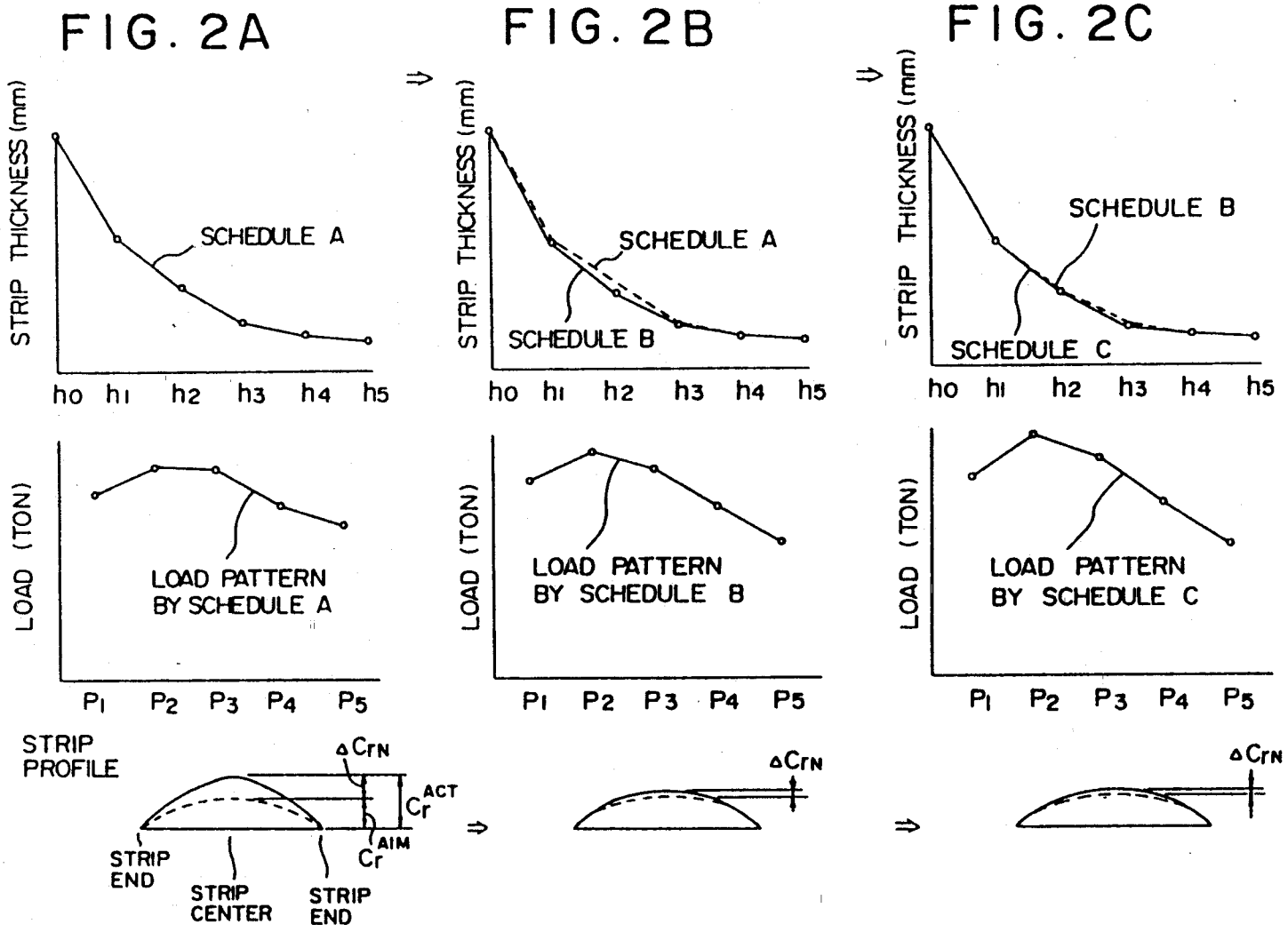
FIGS. 2A, 2B and 2C are schematic diagrams showing a change of the path schedule and strip crown actual value $C_r^{ACT}$ of a continuous coil (A→B→C) of the same lot manufactured by the rolling control apparatus according to the embodiment of the present invention.

FIGS. 2A, 2B and 2C are schematic diagrams showing a change of the path schedule and strip crown actual value $C_r^{ACT}$ of continuous coils (A→B→C) of the same lot manufactured by the rolling control apparatus. For the purpose of simplicity, in FIGS. 2A, 2B and 2C, the number n of stands is set to n=5, and there are shown the path schedules for the three coils (rolled material) of A→B→C, the load patterns for the path schedules, and the strip profiles after executing the hot strip rolling.

Referring to FIGS. 2A, 2B and 2C, the target value of the strip profile is shown by a broken line, and the actual value is shown by a solid line. In order to clearly show the difference therebetween, the target and actual values are shown exaggerated in the widthwise direction of a strip. As seen from FIGS. 2A, 2B and 2C, by changing the load pattern at the rolling mill at each stand in the order of (A)→(B)→(C), the strip profile of a rolled product becomes near the target value.

Figure 3B:
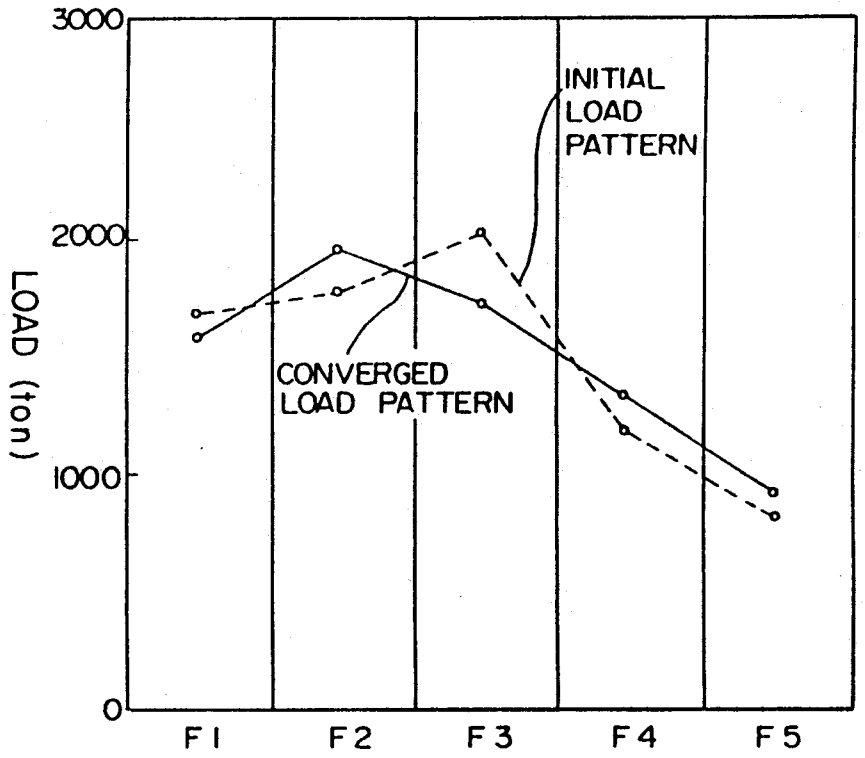
FIGS. 3A and 3B are graphs showing simulation examples of convergence calculation by a load pattern calculator of the rolling control apparatus using the Newton-Raphson method according to the embodiment of the present invention.
Figure 3A:
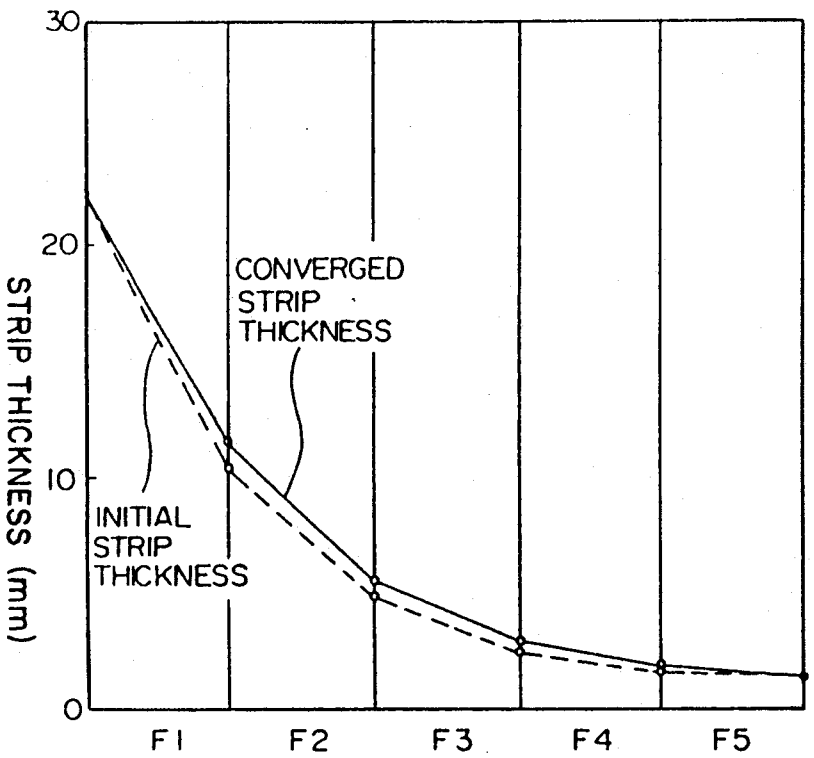

FIGS. 3A and 3B are graphs showing simulation examples of convergence calculation by the load pattern calculator 9 using the Newton-Raphson method. As seen from FIGS. 3A and 3B convergence is achieved by three iterative calculations for the case of $h_0=22$ mm→$h_5=1.5$ mm. In FIGS. 3A and 3B the calculation/setting unit 9 executes a calculation/setting operation in accordance with a converged strip thickness $h_i$, to obtain a path schedule $h_i$ which realizes a load pattern by reducing the strip crown difference $\Delta C_{rN}$. In this manner, a product (rolled material) having a good strip profile can be manufactured.

The points to be considered when applying convergence calculation by the Newton-Raphson method to the load pattern calculator 8 are a manner to obtain an initial solution and the convergence stability. In this connection, first, the sign (not zero) of each term of the Jacobian matrix [J] is analytically checked to confirm that the inverse matrix [J]−1 can be obtained without divergence, and then the strip thickness $h_i$ of the initial solution $\{X_0\}$ is distributed in accordance with the maximum allowable reduction $r_i^*$ to confirm a reliable convergence. With this method, the reduction $r_i$ providing the initial strip thickness is given by:

$$r_i = 1 - (1 - r_i^*) \cdot \left( \frac{1 - r_{tot}}{1 - r_{tot}^*} \right)^{\frac{1}{n}} \tag{20}$$

where $r_{tot}$ represents a total reduction of n stands $(=(h_0-h_n)$, and $r_{tot}^*$ represents the total allowable depression ratio $(=1-(1-r_1^*) * (1-r_2^*) \ldots, * (1-r_n^*))$.

As appreciated from the foregoing description of the present invention, it is possible to obtain the path schedule $h_i$ achieving the target load pattern $\gamma_i^{NEW}$ allowing a stable convergence. Therefore, without giving any external turbulence to the actual operation, a product coil (rolled material) having a good strip profile can be manufactured.

Furthermore, the load pattern $\gamma_i$ obtained at the previous rolling operation may be stored for each lot, so that the stored load pattern $\gamma_i$ can be used as the initial load pattern at the next rolling operation.

We claim:

1. A rolling control method of setting a roll gap $S_1$ and roll peripheral speed $V_i$ at each stand of a tandem mill and controlling the roll gap and roll peripheral speed in accordance with set values so as to obtain a rolled material having a predetermined strip crown, said rolling control method comprising:

(A) detecting a strip profile of a rolled material which has undergone a series of hot strip rolling;

(B) calculating a strip crown actual value $C_r^{ACT}$ of said rolled material in accordance with the detected strip profile;

(C) comparing said calculated strip crown actual value of $C_r^{ACT}$ with a given strip crown target value $C_r^{AIM}$ to obtain a difference $\Delta C_{rN}(=C_r^{AIM}-C_r^{ACT})$ therebetween;

(D) obtaining a crown ratio/load influence coefficient $\delta R_{ci}/\delta P_i$ in accordance with said difference $\Delta C_{rN}$ and crown ratio calculated values $(R_{ci}(P_i+\Delta P_i), R_{ci}(P_i-\Delta P_i), \Delta P_i)$ wherein
$P_i$=the load at the i-th stand of the tandem mill,
$\Delta P_i$=a difference in load at the i-th stand, and;

(E) calculating a load/load ratio influence coefficient $\delta P_i/\delta\gamma_i$ in accordance with given load calculated values $(P_i(\gamma_i+\Delta\gamma_i),(P_i(\gamma_i-\Delta\gamma_i),\Delta\gamma_i)$; wherein
$P_i$=the load at the i-th stand of the tandem mill,
$\gamma_i$=load ratio=$P_i/P_{max}$
$P_{max}$=maximum load
$\Delta\gamma_i$=a difference in load ratio at the i-th stand;

(F) calculating a load ratio correction amount $\delta\gamma_i$ in accordance with a given delivery target value $h_F^{AIM}$, strip crown difference $\Delta C_{rN}$, influence coefficient $\delta R_{ci}/\delta P_i$, and influence coefficient $\delta P_i/\delta\gamma_i$, for the rolled material at a most downstream stand;

(G) calculating a delivery thickness $h_i$ at each stand realizing a load pattern $\gamma_i^{NEW}$ for a next rolled material, in accordance with a given load pattern $\gamma_i^{OLD}$ and said load ratio correction amount $\delta\gamma_i$; and (H) setting the roll gap $S_i$ and roll peripheral speed $V_i$ at each stand in accordance with said calculated delivery thickness $h_i$ at each stand.

2. A rolling control method according to claim 1, wherein a load pattern data at a present rolling operation is stored, and said stored load pattern data is used as an initial load pattern data for a next rolling operation.

3. A rolling control apparatus for setting a roll gap $S_i$ and roll peripheral speed $V_i$ at each stand of a tandem mill and controlling the roll gap and roll peripheral speed in accordance with set values so as to obtain a rolled material having a predetermined strip crown, said rolling control apparatus comprising:

strip profile detecting means for detecting a strip profile of a rolled material which has undergone a series of hot strip rolling;

first calculating means for comparing a strip crown actual value $C_r^{ACT}$ of said rolled material calculated in accordance with the detected strip profile, with a given strip crown target value $C_r^{AIM}$ to obtain a difference $\Delta C_{rN}(=C_r^{AIM}-C_r^{ACT})$ therebetween;

second calculating means for obtaining a load ratio correction amount $\delta\gamma_i$ in accordance with said difference $\Delta C_{rN}$, a crown ratio/load influence coefficient values $(R_{ci}(P_i+\Delta P_i),R_{ci}(P_{i-\Delta Pi}),\Delta P_i)$, a load/load ratio influence coefficient $\delta P_i/\delta\gamma_i$ obtained from given load calculated values $(P_i(\gamma_i+\Delta\gamma_i),(P_i(\gamma_i-\Delta\gamma_i)$ wherein
$P_i$=the load at the i-th stand of the tandem mill,
$\Delta P_i$=a difference in load at the i-th stand,
$\gamma_i$=load ratio=$P_i/P_{max}$
$P_{max}$=maximum load $\Delta\gamma_i$=a difference in load ratio at the i-th stand, and a given delivery target value $h_F^{AIM}$ for the rolled material of a most downstream stand;

third calculating means for calculating a delivery thickness $h_i$ at each stand realizing a load pattern $\gamma_i^{NEW}$ for a next rolled material, in accordance with the load ratio correction amount $\delta\gamma_i$ and a load pattern $\gamma_i^{OLD}$ of the rolled material;

setting means for the roll gap $S_i$ and roll peripheral speed $V_i$ at each stand in accordance with said calculated delivery thickness $h_i$ at each stand; and means for controlling a reduction unit and a roll drive motor at each stand in accordance with said set roll gap $S_i$ and said roll peripheral speed $V_i$.

* * * * *